United States Patent [19]

Wells et al.

[11] Patent Number: 4,867,433

[45] Date of Patent: Sep. 19, 1989

[54] DUAL FEEDING OF SHEETS OF PROCESSING MACHINERY

[75] Inventors: Robert R. Wells, Phoenix; John R. Van Noy, Baltimore; John H. Bachmann, Jr., Fallston, all of Md.

[73] Assignee: The Ward Machinery Company, Cockeysville, Md.

[21] Appl. No.: 158,245

[22] Filed: Feb. 19, 1988

[51] Int. Cl.[4] ..... B65H 3/04

[52] U.S. Cl. ..... 271/35; 271/114; 271/118; 414/797.8

[58] Field of Search ..... 271/114, 117, 118, 35; 414/128, 130

[56] References Cited

U.S. PATENT DOCUMENTS

| | | | |
|---|---|---|---|
| 3,735,976 | 5/1973 | Watson | 271/34 |
| 3,888,479 | 6/1975 | Eder et al. | 271/118 |
| 4,081,945 | 4/1978 | Calvert et al. | 414/128 |
| 4,494,745 | 1/1985 | Ward, Sr. et al. | 271/36 |
| 4,643,413 | 2/1987 | Ward, Sr. et al. | 271/34 |

*Primary Examiner*—Joseph J. Rolla
*Assistant Examiner*—Steve Reiss
*Attorney, Agent, or Firm*—Boyce C. Dent; Edward D. C. Bartlett

[57] ABSTRACT

Sheet feeding apparatus, particularly for feeding corrugated paperboard sheets to container blank processing machinery, has an indexing transmission for cyclically accelerating and decelerating belts or the like for frictionally engaging and feeding sheets from an end of a stack of sheets. A cam arrangement cyclically shifts the feed belts or the like relative to a stack support surface between an operative position for feeding and an inoperative position. The accelerating and decelerating cycle of the belts occurs twice per machine cycle. The cam arrangement preferably comprises a single lobe cam and a double lobe cam, either of which can be selectively chosen for shifting the belts. When feeding one sheet per machine cycle of the downstream machinery, the single lobe cam is employed to shift the belts into the operative mode only once per machine cycle. Shorter sheets can be fed at twice the production rate by employing the double lobe cam to shift the belts into the operative mode twice per machine cycle, this mode taking advantage of the second accelerating/decelerating cycle of the belts.

22 Claims, 7 Drawing Sheets

DUAL FEEDING OF SHEETS OF PROCESSING MACHINERY

FIELD OF THE INVENTION

This invention relates to sheet feeding apparatus for, and methods of, feeding sheets to downstream processing machinery, for example feeding paperboard sheets to container blank processing machinery. The invention is particularly concerned with dual feeding of sheets.

BACKGROUND OF THE INVENTION

It is known to feed corrugated paperboard sheets to container blank processing machinery by frictionally engaging an end sheet of a stack of sheets with stationary feed belts, accelerating the belts to accelerate the sheet being fed to the throughput speed of and in register with the downstream machinery, and then shifting the feed belts to an inoperative position out of contact with any sheet until the next end sheet to be fed is similarly engaged. Such sheet feeding apparatus is disclosed in Ward Sr. et al U.S. Pat. No. 4,494,745 (assigned to The Ward Machinery Company) the whole disclosure of which is hereby incorporated herein by reference.

Such sheet feeding apparatus normally feeds one sheet per machine cycle of the downstream container blank processing machinery. It can also be operated in a skip feed mode for feeding longer sheets at half the production rate, that is one longer sheet per two machine cycles. However, with short sheets, even very short sheets, the maximum feeding capability of this feeder is one sheet per machine cycle.

It has previously been recognized that it would be advantageous if sheet feeding apparatus could be developed that could feed from a stack of sheets two smaller corrugated paperboard sheets per machine cycle. An attempt to do this was made by The Ward Machinery Company many years ago. This involved using a kick feed type of sheet feeder (in which a reciprocating kicker engages and positively drives the trailing edge of a sheet) and trying to operate it at twice its normal feed rate to feed two smaller sheets instead of one per machine cycle. Also, to feed one larger sheet per machine cycle, a skip feed mechanism was employed having one or more fingers which raised the stack of sheets above the reciprocating kicker once every other half machine cycle. After trying this out in production on a few container blank processing machines, the modified kick feed was found totally unsatisfactory at double speed production rates. Later, this approach using a double speed kick feeder was tried again in production but again was found unsatisfactory. The conclusion was drawn that this double feed problem could not be solved using a kick feed type sheet feeder, and this approach was abandoned as a failure.

For years the container blank manufacturing industry has waited in need for a sheet feeding apparatus that could successfully and reliably feed two smaller corrugated paperboard sheets per machine cycle of the downstream container blank processing machinery.

SUMMARY OF THE INVENTION

The present invention is based on the realization that a friction sheet feeder, for example employing a cyclically operated and shifted belt, only needs the friction feeding belt or member to be operative for less than 180 degrees in a 360 degree machine cycle. The present invention is further based on the realization that the remaining 180 degrees of the full machine cycle could be utilized to selectively feed a second sheet when approximately half maximum length, or less, sheets were to be fed, and that the individual sheets could be accelerated at the same rate of acceleration whether one or two sheets were fed per machine cycle.

It is an object of the present invention, therefore, to provide a sheet feeder and a method of feeding sheets whereby standard length sheets can be fed one per machine cycle of the downstream machinery, and half length sheets can be successively fed two per machine cycle.

A feature by which this object is achieved in the preferred embodiment of the invention is to employ two cams optionally operable to shift a feeding belt between an operative position and an inoperative position, one cam shifting the belt once per machine cycle and the other cam shifting the belt twice per machine cycle.

Another feature of the preferred embodiment is to arrange two timed acceleration and deceleration sequences of the feeding belt per machine cycle, both timed sequences only being operative to feed two sheets per cycle when the cam shifting the belt twice per machine cycle is rendered operative.

These features provide the advantage that one or two sheets can be fed per machine cycle without changing the acceleration rate or velocity of feed of the sheets, whether one or two sheets are being fed per machine cycle.

Accordingly, there is provided by one aspect of the present invention a sheet feeding apparatus for supplying sheets to cyclically operating downstream machinery, comprising supporting means for supporting a stack of sheets, the stack having an upper end and a lower end, feeding means for feeding sheets from one of the ends of the stack, the sheets being fed one at a time in a forward direction towards and in register with the downstream machinery which performs a production operation on each fed sheet once per machine cycle of the downstream machinery, and shifting means for shifting the supporting means and the feeding means relative to each other in a direction transverse to the forward direction from an inoperative position, in which the feeding means cannot feed any sheet, to an operative position in which the feeding means can feed a respective one of the sheets, and then back to the inoperative position in a timed sequence which occupies less than half of one machine cycle. Drive means is provided for successively accelerating and decelerating the feeding means in a timed cycle which is less than half of one machine cycle, the drive means being capable of performing successively at least two such timed cycles per machine cycle. Mode means, selectively operable between a single mode and a multiple mode, for causing the timed sequence of the shifting means to be carried out once per machine cycle in the single mode and more than once per machine cycle in the multiple mode, and means for interrelating the feeding means, the shifting means, the drive means, and the mode means with each other and the downstream apparatus to enable at least two sheets to be successively fed from the stack per machine cycle in the multiple mode and only one sheet to be fed from the stack per machine cycle in the single mode.

Preferably the shifting means comprises two cams and may include a cam follower. The mode means preferably comprises means for displacing this cam follower relative to the two cams to effect alignment of the cam follower with one of the cams in the multiple mode and the other of the cams in the single mode.

The two cams may be mounted side by side on a common shaft, one of the cams having two diametrically opposed cam lobes, and the other of the cams having only one cam lobe.

The drive means preferably comprises an indexing transmission having an output shaft drivingly connected to the feeding means and a continuously rotated input shaft, the output shaft performing two similar timed cycles for each revolution of the input shaft.

Although the preferred embodiment has a single mode and a double mode using a single lobe cam and a two lobe cam, respectively, the double mode can be extended to a multiple mode. For the multiple mode three or more cams may be placed side by side, these cams having a progressively increasing number of cam lobes. For example, there may be three cams with one, two and three cam lobes respectively, the cam follower being transversely movable to register with any selected one of the three cams. With this arrangement, the feeding apparatus can feed one two or three sheets per machine cycle; when feeding three sheets per machine cycle the sheets would be very short, less than one third of the length of a maximum length singly fed sheet.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

The preferred embodiment of the sheet feeding apparatus of the present invention is illustrated in FIGS. 2 to 8. Curves helping to illustrate the operation of the sheet feeding apparatus are illustrated in FIG. 9, and an environment in which the sheet feeding apparatus can be employed is illustrated in FIG. 1.

Figure 1:
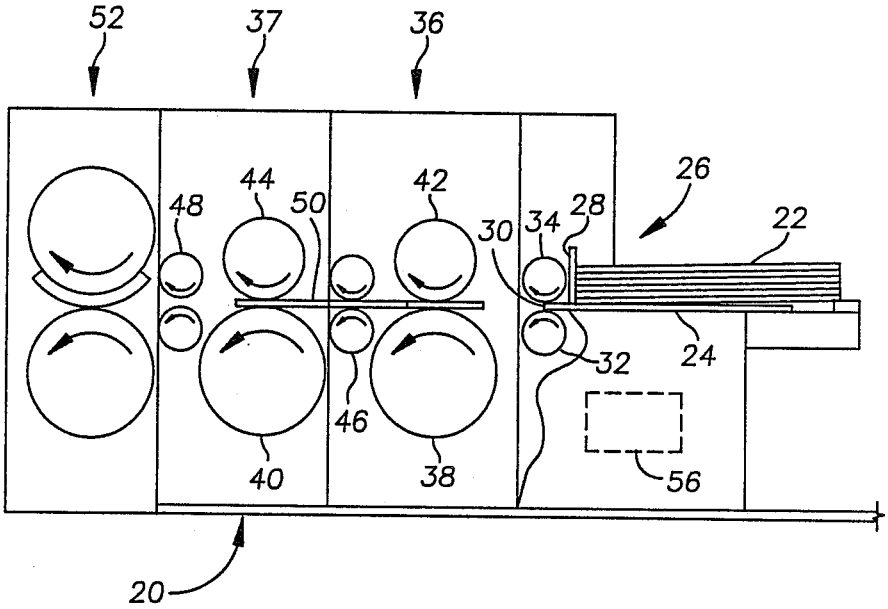
FIG. 1 is a diagrammatic simplified side view of a flexographic rotary die cutter and/or slotter machine incorporating the sheet feeding apparatus of the present invention, a near side frame being mostly omitted and some parts being shown in section.

FIG. 1 illustrates a flexographic rotary die cutter and/or slotter machine 20 used for the production of container blanks from corrugated paperboard sheets. A stack 22 of the sheets is formed on a support surface 24 in a sheet feeding section 26. A forward gate 28 allows only one sheet at a time to be fed forwardly from the stack 22 by the sheet feeding apparatus to a pair of nip rolls 32, 34 driven in the direction shown by arrows. Each sheet so fed is always the awaiting outer sheet 30 at the lower end of the stack 22.

The fed sheet is then advanced at a constant linear throughput speed through two adjacent printing sections 36, 37 here illustrated as having two printing cylinders 38, 40 cooperating with respective platen or impression rolls 42, 44 with a pair of nip rolls 46, 48 after each printing cylinder 38, 40. A sheet 50 is illustrated passing from the first printing roll 38 to the second printing roll 40. Downstream from the printing sections 36, 37 is a further section 52. This section 52 is preferably a rotary die cutter section but may be a slotting section, both of which sections are well known in the art and do not require further description. Also, as is well known, the section 52 could be extended to include both a rotary die cutter section followed by a slotting section.

All the rollers, printing cylinders, impression rolls etc. are interconnected by gearing to cause them to all rotate at the same peripheral surface speed. The whole machine may be driven by one motor. An indexing transmission 56 of the sheet feeding apparatus is indicated in broken lines below the stack support surface 24.

Figure 2:
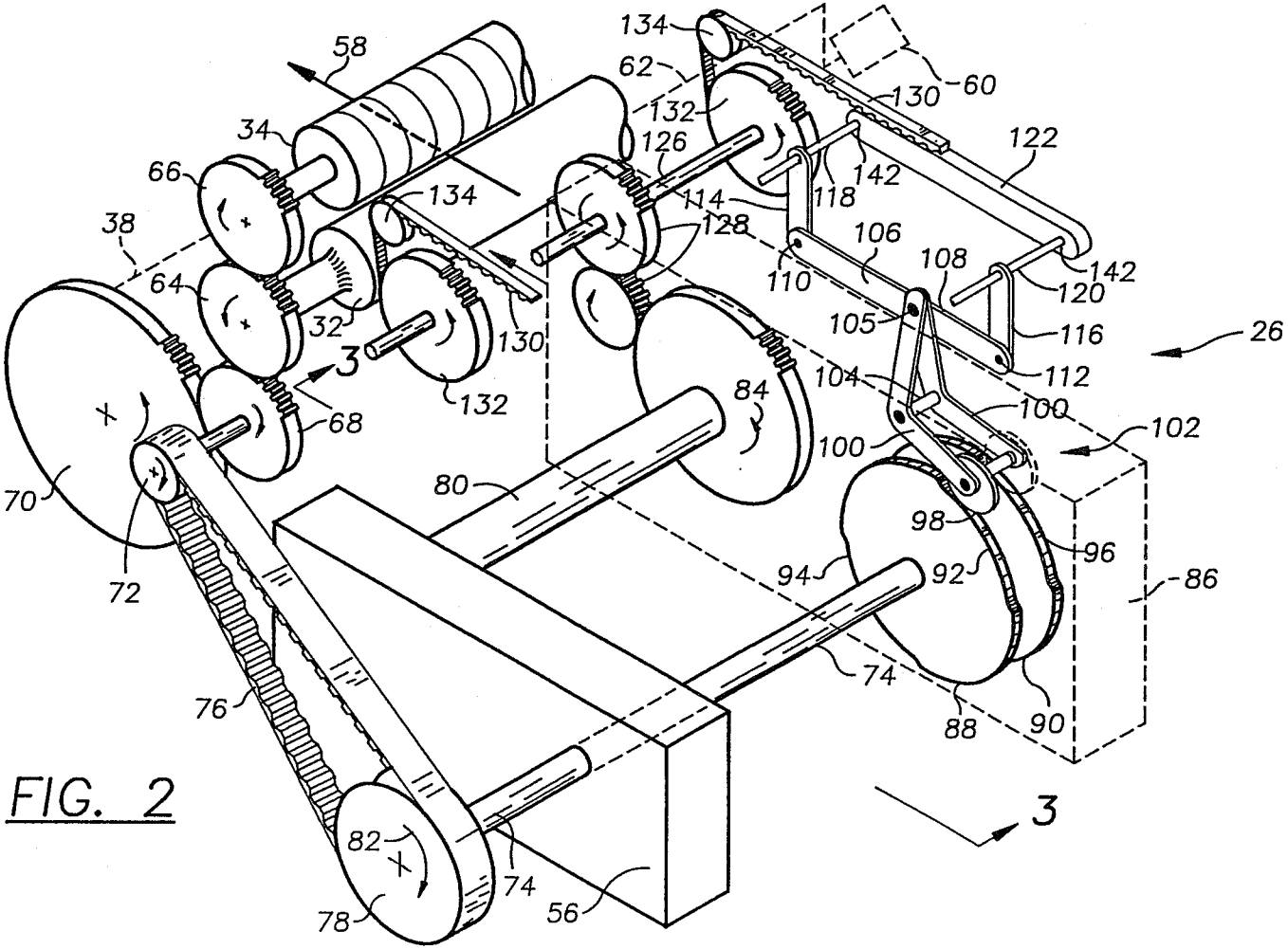
FIG. 2 is a diagrammatic simplified perspective view of the sheet feeding apparatus of the present invention, as incorporated in the machine of FIG. 1, with many parts omitted for simplicity.

FIG. 2 shows in a simplified manner a perspective view of the sheet feeding apparatus of the sheet feeding section 26 of FIG. 1. FIG. 2 shows the nip rolls 32, 34 and the indexing transmission 56 shown in FIG. 1, and an arrow 58 indicates the direction of sheet feed to more fully orientate the simplified perspective view of FIG. 2 with respect to the machine of FIG. 1.

The nip between the nip rolls 32, 34 is exaggerated for clarity, in operation this nip would be just less than the thickness of the corrugated sheets being fed. The lower nip roll 32 is rotatably driven by an electric motor 60 via pulleys and belts 62, both shown schematically by broken lines, this providing the main drive input to the sheet feeding section 26 and the downstream machine sections 36, 37 and 52. A gear 64 on an end of the nip roll 32 meshes with a gear 66 on the upper nip roll 34 to drive the latter. The gear 64 also drives a gear 68 which in turn meshes with and drives a gear 70 mounted on the shaft of the printing cylinder 38 of the first printing section 36. The second printing cylinder 40, its impression roll 44, the cutting die roll and anvil roll of the rotary die cut section 52 (and/or the slotting section), together with the pairs of nip rolls 46, 48, are all driven via suitable gearing driven by the gear 70. Each complete revolution of the gear 70 defines a machine cycle of the flexographic machine 20 including the sheet feeding section 26.

A timing belt pulley 72 is secured on a shaft of the gear 68 and rotates in unison therewith. An input shaft 74 to the indexing transmission 56 is continuously rotatably driven from the timing pulley 72 via a timing belt 76 and a timing belt pulley 78 on an outer end of the shaft 74. The transmission 56 has an intermittently driven output shaft 80 which performs two identical indexing cycles for each complete revolution of the input shaft 74. The drive train 68, 72, 76, 78 is selected to effect one complete revolution of the input shaft 74 for each complete revolution of the printing section gear 70, i.e. the input shaft 74 rotates once per machine cycle.

As the input shaft 74 is rotated continuously at a uniform speed, the output shaft 80 is driven by the transmission 56 through two indexing timed cycles per machine cycle. Each such indexing timed cycle starts with the output shaft 80 stationary, rotationally accelerates the shaft 80, and then rotationally decelerates the shaft 80 to rest as illustrated in FIG. 9 to be described later. The input shaft 74 rotates clockwise as indicated by the arrow 82, and while the output shaft 80 is rotating, it always rotates counterclockwise as indicated by the arrow 84. A suitable indexing transmission is a 3-stop, parallel shaft, unit available commercially from the Commercial Cam Division of Emerson Electric Company, 1444 South Wolf Road, Wheeling, Ill. 60090 in which 160 degrees of rotation of the input shaft provides 120 degrees of indexed rotation of the output shaft.

The input shaft 74 extends through and beyond the housing of the transmission 56 and is journaled at its far end in a center cam box 86 the housing of which is shown in broken lines. A pair of cams 88, 90 are secured on and rotated by the input shaft 74. The cams 88, 90 are mounted side by side, have the same outer diameter, but the cam 88 is a double action cam with two diametrically opposed cam lobes 92, 94 and the cam 90 is a single action cam with a single cam lobe 96. Each cam lobe is formed by a depression in the outer circumference of an otherwise circular disc-like cam. The two cams 88, 90 drive a single cam follower in the form of a freely rotatable wheel 98 journaled between spaced apart sides 100 of a cam follower lever 102 pivotally mounted on a short shaft 104. The ends of the shaft 104 are journaled in upward side extensions of the cam box housing 86 (see FIG. 3). An upper end of the lever 102 is pivotally connected at 105 to the inner ends of two horizontal links 106, 108. The outer ends of the links 106, 108 are respectively pivotally attached at 110, 112 to lower ends of levers 114, 116 rigidly secured at their upper ends to cross-shafts 118, 120. These two cross-shafts extend substantially the full width of the sheet feeding section 26 and support a plurality of transversely spaced apart and parallel lifter bars 122, only one of which is illustrated for simplicity. Upon pivoting of the lever 102 as the wheel 98 follows one or other of the cams 88, 90, the cross-shafts 118, 120 are oscillated via the links 106, 108 and levers 114, 116; this oscillation of the cross-shafts causes the lifting bars 122 to shift up and down, while remaining horizontal, as will be explained in more detail in relation to FIG. 3. The cam follower wheel 98 is shown in full lines in engagement with the double lobe cam 88, and in broken lines in engagement with the single lobe cam 90; a mode changing mechanism (illustrated in FIG. 4) moves the wheel 98 transversely to register with the selected cam 88 or 90.

The indexed output shaft 80 of the indexing transmission 56 extends into and is journaled in the forward end of the cam box 86. A gear 124 rigidly mounted on the output shaft 80 drives a sheet feed shaft 126 via meshing gears 128. The shaft 126 extends transversely across and is appropriately journaled in the sheet feed section 26 below the support surface 24 thereof (FIG. 1). A plurality of sheet feeding belts 130 (only two shown for simplicity) are driven by timing belt pulleys 132 secured on the shaft 126. The belts 130 have an outer sheet feeding surface having a high coefficient of friction, and are in the form of timing belts each of which passes around the driving pulley 132, an upper forward idling pulley 134, and an upper rear idling pulley 136 (see FIG. 3). The belts 130 are intermittently accelerated, decelerated and stopped twice per machine cycle by the indexed driving rotation of the output shaft 80.

Figure 3:
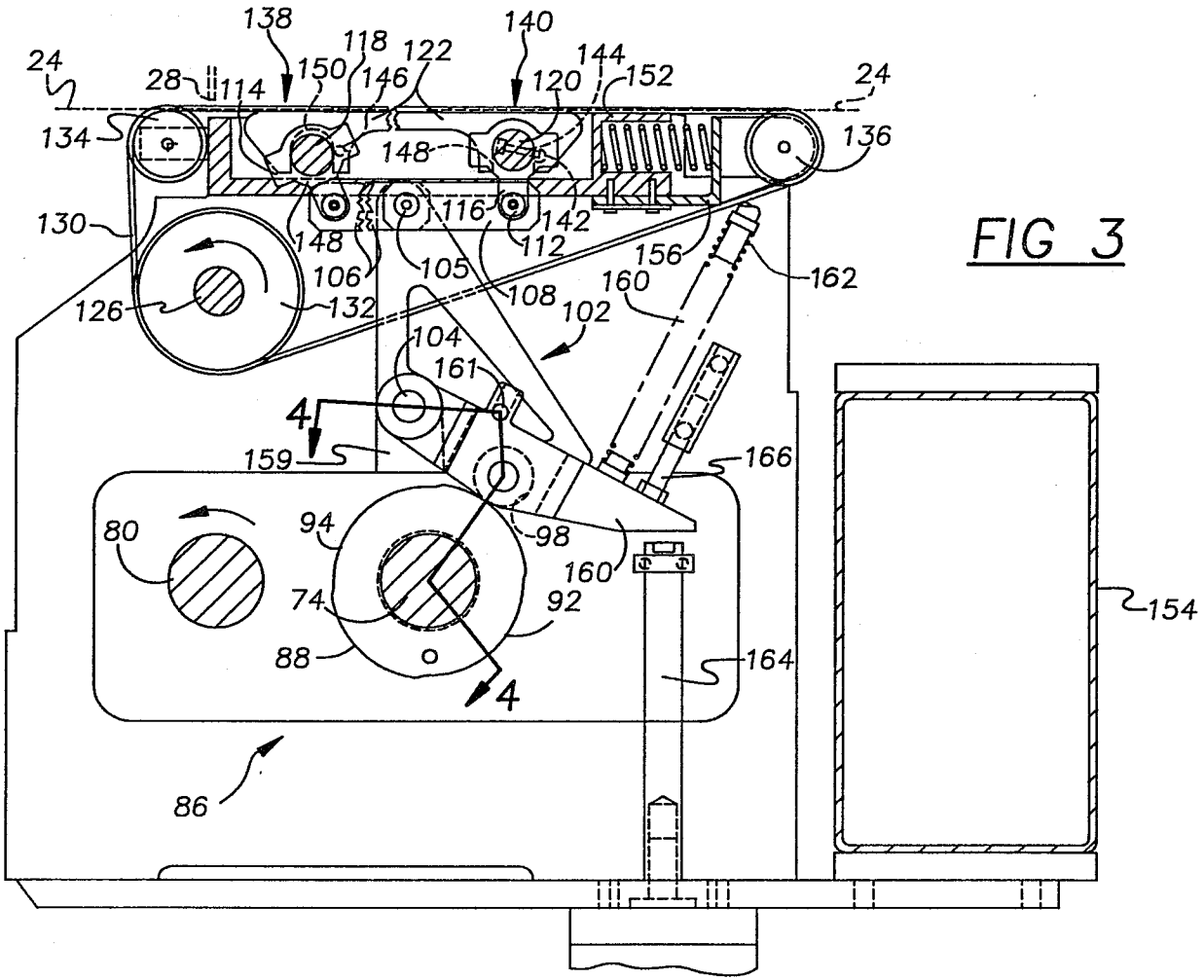
FIG. 3 is a section on the line 3—3 of FIG. 2 more accurately illustrating the shifting means and a sheet feeding belt, but with some parts omitted for simplicity.

As the cams 88, 90 are rotated by the input shaft 74, the respective cam 88 or 90 raises and lowers the lifter bars 122 to raise and lower the upper flights of the belts 130 above and below the support surface 24 (FIGS. 1 and 3). The upper flights of the belts 130 are thus shifted relative to the stack support surface between an upper and operative position for sheet feeding and a lower inoperative position in which no sheet feeding occurs. The upper flights of the belts 130 are thus raised and lowered through longitudinal slots (not shown) in the stack support surface 24. For further details relating to the mounting of the feeding belts 130 below the stack support surface 24 and the raising of the upper flights of the belts 130 therethrough, reference is made to previously mentioned U.S. Pat. No. 4,494,745.

FIG. 3 is a section on the line 3—3 in FIG. 2 but showing additional and more accurate detail than FIG. 2, although some parts have been omitted for clarity and the outline of the cam box housing 86 is shown schematically in full lines. The pivoted cam follower lever 102 is shown in more accurate detail, and is also shown in perspective view in FIG. 7. The cam follower wheel 98 is shown in contact with a radially larger portion of the double lobe cam 88 between the two radially smaller cam lobes 92, 94. In this position the lever 102 has been pivoted counterclockwise about pivot shaft 104 to lower the links 106, 108 thus lowering or shifting the upper flight of the belt 130 below the stack support surface 24 (shown in broken lines) to the inoperative position shown on the upper righthand side of FIG. 3. When the cam rotates until the wheel 98 engages in the depression of the cam lobe 94 (and also subsequently in the cam lobe 92) the lever 102 is pivoted clockwise so raising the pivot 105 and the connected links 106, 108 to raise or shift the upper flight of the belt 130 to the operative position above the support surface 24 as shown on the upper lefthand side of FIG. 3. The operative position of the upper flight is referenced 138 and the inoperative position 140. The levers 114, 116 are T-shaped and are each clamped to their respective cross-shaft 118, 120 to cause the shafts 118, 120 to oscillate via the links 106, 108 by the pivoting of the cam follower lever 102. A plurality of cylindrical keys 142 are secured to the respective cross-shaft, each key 142 being so secured by a bolt 144 extending diametrically therethrough in alignment with the respective lifter bar 122. Each key 142 is rotatably mounted in a cylindrical cavity 146 in a side of an inverted U-shaped recess 148 under the respective end portion of the lifter bar 122. In the inoperative belt position 140 the lever 116 is upright. When in this position, the cylindrical key 142 and the cavity 146 engaged thereby are to one side of the respective shaft 120, 118 just below the level of the central axis thereof. In the operative belt position 138, the lever 114 is forwardly inclined and oscillates the respective shaft 120, 118 so causing the respective cylindrical key 142 to move the cylindrical cavity 146 upwardly, thus shifting the lifter bar 122 upwardly with respect to the support surface 24; in this position the upper curved surface 150 of the recess 148 is moved upwardly out of contact with the cross-shaft as shown in broken lines on the lefthand side of FIG. 3.

The lifter bars 122 are mounted in a vacuum chamber 152 which communicates with a vacuum supply duct 154 for applying vacuum through the support surface 24 to draw the bottom sheet to be fed, and while being fed, into firm engagement with the upper flights of the feeding belts 130 when in the operative position 138. For further details of the vacuum chamber 152 and the application of the vacuum to improve the frictional grip of the feed belts 130 on the sheet being fed, reference is made to the above mentioned U.S. Pat. Nos. 4,494,745.

The rear idler pulley 136 is journaled in a slidable bracket 156 which is rearwardly resiliently biased by a spring 158 to tension the belt 130 while allowing shifting upwardly and downwardly of the belt's upper flight.

The pivot shaft 104 of the lever 102 is journaled in a pair of lugs 159 extending upwardly from sides of the cam box housing 86. A displaceable rod 161 is slidably mounted through the lever 102 for displacing the cam follower wheel 98 between single and multiple modes.

The cam follower lever 102 has a rearward projection 160 beyond the wheel 98, this projection 160 being acted upon by a spring 162 to urge the wheel 98 towards and into contact with the respectively selected cam 88 or 90. An air cylinder 164, normally having its operating rod in the retracted position shown, can be actuated to engage the projection 160 and pivot the lever 102 counterclockwise to raise the cam follower wheel 98 off the respective cam 88, 90, or at least to a position in which the wheel 98 cannot follow into the cam lobes. An adjustable stop 166 limits upward displacement of the projection 160 by the air cylinder 164. The air cylinder 164 is actuated to provide "skip" feed or "stop" feed modes of the sheet feeding apparatus as explained in the above referenced U.S. Pat. No. 4,494,745.

Figure 4:
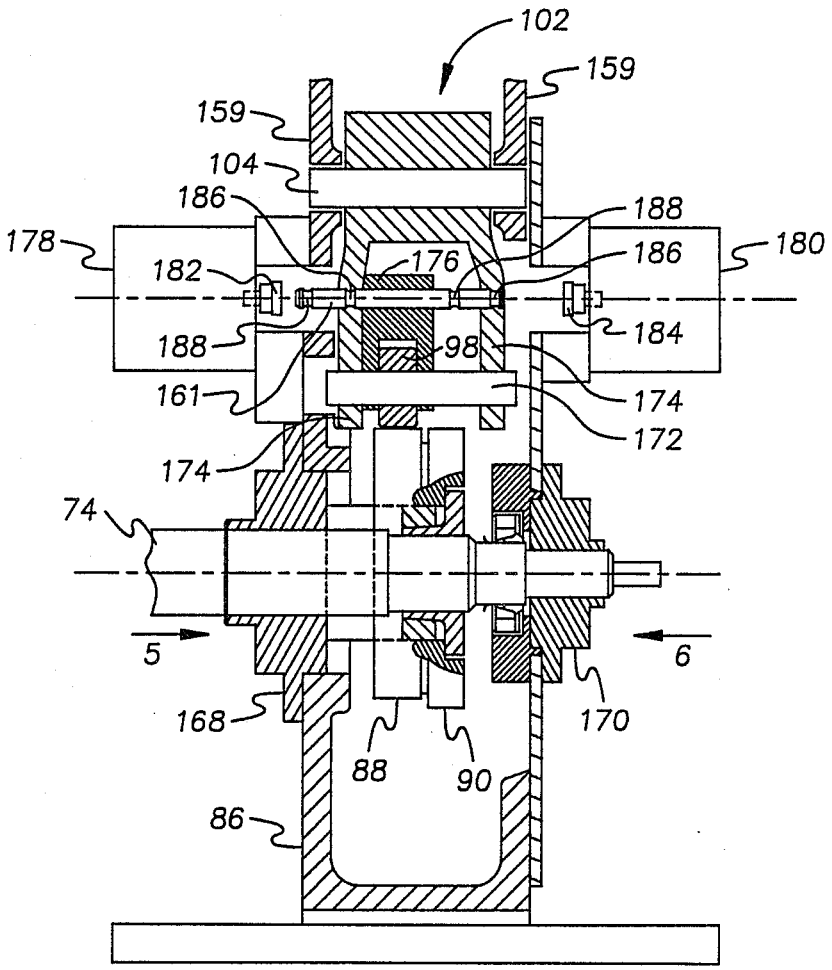
FIG. 4 is a section developed on the line 4—4 in FIG. 3.

FIG. 4 is a section developed along the line 4—4 in FIG. 3, the section line changing direction at the central axes of the input shaft 74, the wheel 98, and the rod 161. The input shaft 74 is journaled in bearings 168, 170 supported in opposite side walls of the cam box housing 86. The cams 88, 90 are mounted side by side on the input shaft 74 between the bearings 168, 170. The two cams 88, 90 are machined integrally from a common blank, the integral pair of cams being rigidly secured on the shaft 74 for rotation therewith. The cams 88, 90 are shown partly in section and partly in end view. The cam follower wheel 98 is rotatably mounted on an axle supported by spaced apart side walls 174 of the cam follower lever 102. The wheel 98 is slidable axially along the axle 172 by a yoke 176 which has leg portions engaging each side of the wheel. The yoke 176 is rigidly mounted on the rod 161 which is disposed above and parallel to the axle 172. Displacement axially of the rod 161 by either of two air cylinders 178, 180, supported by the cam box 86, moves the rod between an extreme lefthand position shown, with the wheel 98 in alignment with the double lobe cam 88, and an extreme righthand position in which the wheel 98 is in alignment with the single lobe cam 90. The air cylinders 178, 180 have rams 182, 184 which, when actuated, push against the respective end of the rod 161, and having fully pushed the rod 161 to the right or the left, then retract again into the air cylinders to be spaced from the ends of the rod 161 as shown. The rod 161 is latched in either righthand or lefthand position by either of two pairs of circumferential detent grooves 188 or 186, being engaged by a resiliently loaded latch member (shown in FIG. 8) in each side wall 174. In FIG. 4 the rod 161 is in the lefthand position and the spaced apart pair of grooves 186 are aligned with the side walls 174; when the rod 161 is displaced to its righthand position, the other pair of grooves 188 become aligned with the side walls 174.

Figure 5:
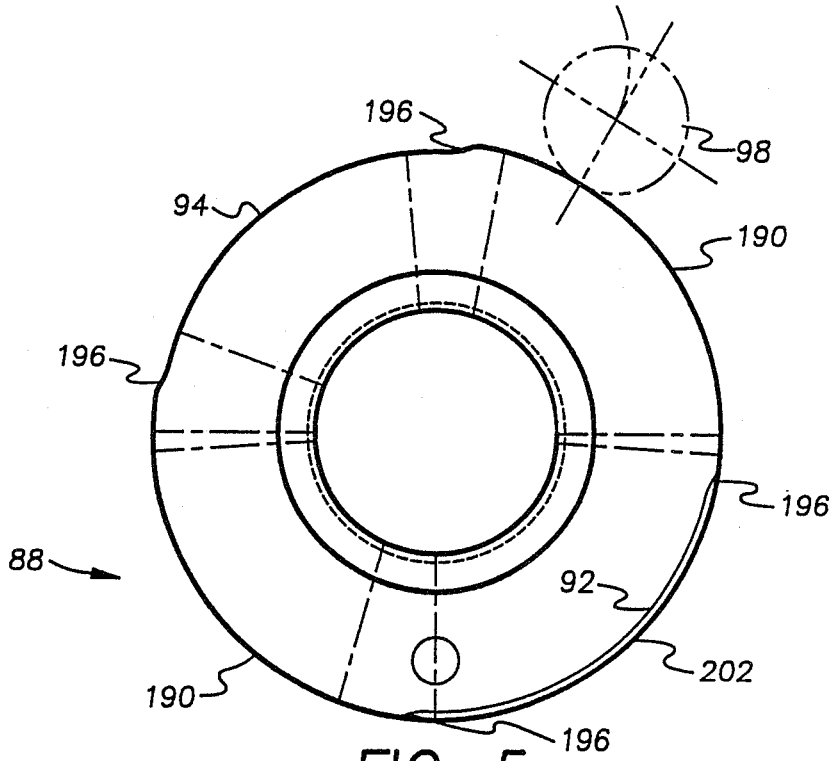
FIG. 5 is an elevational view of a double lobe shifting cam in the direction of the arrow 5 in FIG. 4.

FIG. 5 shows the profile of the double lobed cam 88 in the direction of the arrow 5 in FIG. 4. The cam 88 has two radially outer cylindrical surface sections 190 equally spaced apart, and two radially inner cylindrical lobe sections 92, 94. The lobe sections 92, 94 are each smoothly connected at their ends to the cylindrical outer sections 190 by transitional ramps 196. The outer and inner cylindrical sections 190, 92, 94 are concentric with the central rotational axis 198 of the cam 88. Both outer sections 190 have the same radius, and both inner lobe sections 92, 94 have the same but smaller radius. Thus, the cam lobes 92, 94 are formed by depressions or reliefs in the cam 88 as shown. The cam lobes 92, 94 are symmetrical and diametrically opposite each other with respect to the axis 198. Either cam lobe 92, 94 and either adjacent outer section 190 occupy together an arc of 180 degrees about axis 198. Each outer cylindrical arc section 190 subtends an angle of 73 degrees at the axis 198, and each inner cylindrical arc section 92, 94 subtends an angle of 67 degrees at the axis 198. Each transitional ramp 196 subtends an angle of 20 degrees at the axis 198.

Figure 6:
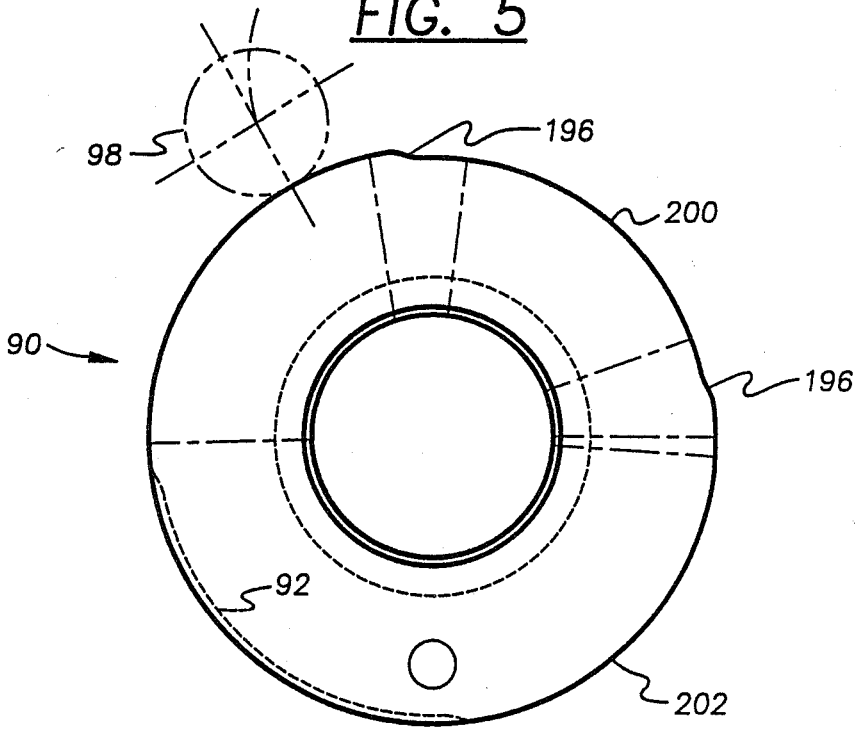
FIG. 6 is an elevational view of a single lobe shifting cam in the direction of the arrow 6 in FIG. 4.

FIG. 6 shows the profile of the single lobe cam 90 in the direction of the arrow 6 in FIG. 4. The cam profile of the cam 90 is the same in both shape and size to the cam profile of cam 88, except cam 90 only has one recessed cam lobe 200 (of the same size as either cam lobe 92, 94) with an outer cylindrical section 202 which subtends an angle of 253 degrees at the common central rotational axis 198. In FIG. 6, the relative position of the cam lobe 92 of the double lobe cam 88 is indicated by a broken line; the other cam lobe 94 of the cam 88 falls directly behind the coincident with the cam lobe 200. In FIG. 5, a portion of the outer cylindrical section 202 of the single lobe cam 90 can be seen behind the cam lobe 94 of the double lobe cam 88.

Figure 7:
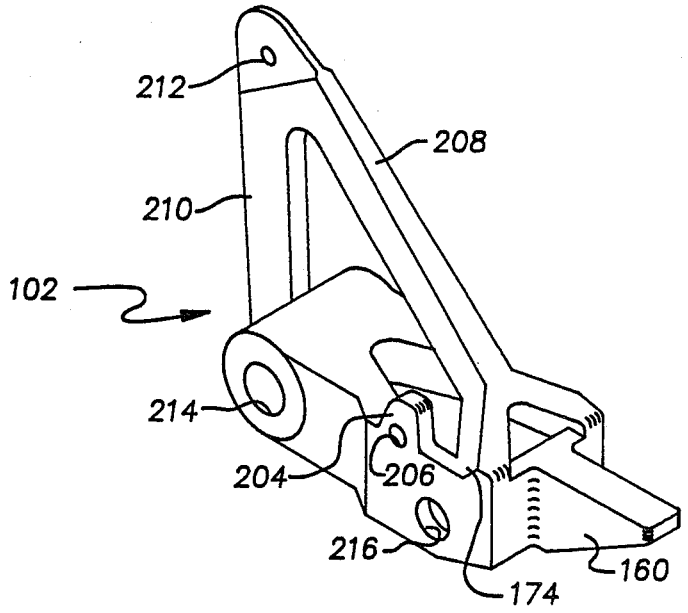
FIG. 7 is a perspective view of the pivotal cam follower lever in FIG. 3.

FIG. 7 shows a perspective view of the cam follower lever 102 showing the projection 160 and one of the side walls 174. A projection 204 extending upwardly from this side wall 174 has a bore 206 which receives one end of the rod 161 (FIGS. 3 and 4). The lever 102 has two upwardly extending arms 208, 210 which merge at their upper ends at which a bore 212 is provided for the pivotal connection 105 (FIGS. 2 and 3). The lower forward end of the arm 208 forks as it merges into the side walls 174. Bores 214, 216 are provided respectively for the pivot shaft 104 and wheel axle 172 (FIGS. 3 and 4).

Figure 8:
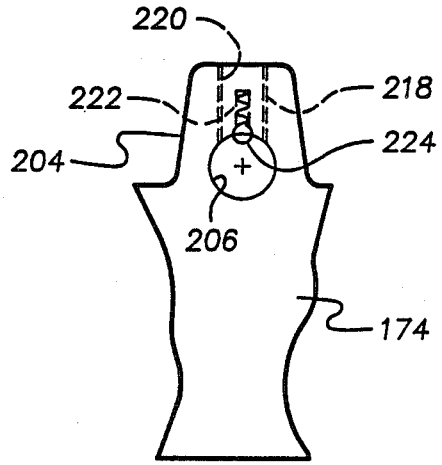
FIG. 8 is a side view of a fragment of the cam follower lever of FIG. 7 illustrating part of a latching mechanism.
Figure 9:
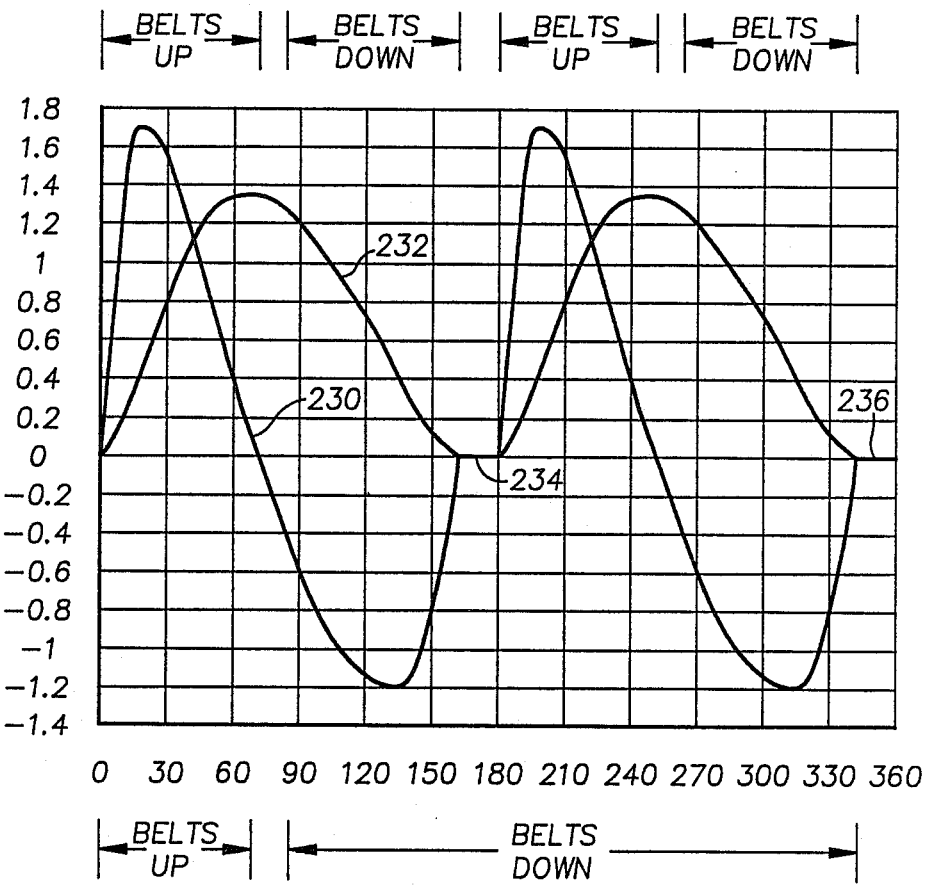
FIG. 9 is a diagram showing feed belt velocity per machine cycle in one curve, and acceleration/deceleration of the output shaft of the indexing transmission in another curve.

FIG. 8 is a fragmentary view of a portion of the cam follower lever 102 showing one of the two projections 204 upstanding from its respective side wall 174. Each projection 204 has a downward screw-threaded bore 218 into which is screwed a latch unit 220 containing a spring 222 and a small ball 224. The spring 222 resiliently urges the ball 224 downwardly to project into the bore 206 through which the rod 161 (FIGS. 3 and 4) slides. The upward projection 204 on each side of the lever 102 has such a spring-loaded ball 224, these balls 224 releasably engaging in the pairs of detent grooves 186, 188 (FIG. 4) and forming the latch members for locating the yoke rod 161 in either end position.

In use, the feeding section 26 can be used in the single mode with standard length sheets having a length usually just less than the length of the periphery of the printing cylinder 38. It can also be used in the skip feed mode (but at half the production rate of standard length sheets) with long sheets having a length up to just under twice the length of the periphery of the printing cylinder. Now, according to the invention, it can also be used in the double mode with short sheets having a length less than half the periphery of the printing cylinder, but at twice the production rate of standard length sheets.

The operation of the machine will be described first with standard length sheets, e.g. with a printing cylinder peripheral length of 66 inches, sheets having a length of 61 inches; the feeding section 26 will then be in the single mode with the cam follower wheel 98 engaging the single lobe cam 90.

In operation in the single mode, the motor 60 drives both the sheet feeding section 26 and, via the gear 70, the other sections 36, 37, 52 at a constant throughput speed, for example 170 rpm of the print cylinders 38, 40 and the die cutter roll, each single revolution of these representing a machine cycle. The input shaft 74 is also so driven at 170 rpm. Each machine cycle, the upper flights of the belts 130 are raised, while the belts 130 are stationary, by the cam 88 and cam follower lever 102 into static frictional engagement with the bottom sheet in the stack 22. The output shaft 80 of the indexing transmission now starts accelerating to start the belts 130 in forward feeding motion and accelerate them to the throughput speed of the machine 20, i.e. to the circumferential surface speed of the cylinders 38, 40, etc. The belts 130, while in static frictional engagement with the bottom sheet, accelerate this sheet 30 until it reaches the throughput speed of machine 20, at which point the leading portion of the sheet 30 is gripped in the nip of the nip rolls 32, 34. The cam 90 then causes the lever 102 to lower the upper flights of the belts 130 out of contact with the sheet 30, and at the same time the output 80 shaft starts decelerating so commencing deceleration of the belts 130. The output shaft and the belts 130 decelerate to rest, and dwell for a short period at rest with the upper flights of the belts 130 remaining below the stack support surface 24. With the belts 130 remaining in their lower, inoperative position, the output shaft 80 performs a second timed cycle of accelerating, decelerating and dwelling at rest; the belts 130 are driven thereby through a second acceleration/deceleration cycle but do not contact or feed a sheet because the belts are still in the inoperative position with their upper flights below the stack support surface 24. Before the end of this second timed cycle, the sheet 30 being fed has cleared the gate 28. The input shaft 74 has now completed one revolution, and as it starts another revolution, the above sequences are repeated with the next bottom sheet in the stack 22 now being similarly fed to the nip rolls 32, 34. In this way, one sheet is fed by the feeding section 26 per machine cycle, and although the belts 130 are driven through two timed acceleration/deceleration cycles per machine cycle, only one of these timed cycles occurs with the belts 130 in the operative position. It will be noticed that while the cam follower wheel 98 engages the outer cylindrical section 202 of the cam 90, the upper flights of the belts 130 remain in the inoperative position below support surface 24; but when the wheel 98 follows in the cam lobe 200, these upper belt flights are shifted up to the operative position.

To use the machine 20 with longer sheets, for example sheets about twice as long as the maximum length sheets, apart from any consequential changes of or adjustments to the printing dies, rotary cutting dies etc., the machine operates similarly as above with the cam follower wheel aligned with the single lobe cam 90, but in the skip feed mode. In the skip feed mode, the air cylinder 164 is actuated every other machine cycle to prevent the cam follower wheel 98 from following into the cam lobe 200. Thus, during every other machine cycle the upper flights of the belts 130 remain lowered in the inoperative position for the whole of that machine cycle. The belts 130 are only shifted into the operative position once every two machine cycles so that a longer sheet is only fed every other machine cycle.

To use the machine 20 with the shorter sheets, e.g. sheets having a length of 28 inches or possibly a little longer, the cam follower wheel is placed on the double lobe cam 88 to change the feeding section 26 to the double mode. This is done by actuating the air cylinder 164 to engage the projection 160 of the lever 102 and maintain the lever 102 pivoted counterclockwise as in FIG. 3 to prevent the wheel 98 from following into the cam lobes. The air cylinder 180 is then actuated to translate the rod 161 and move the wheel 98 to alignment with the double lobe 88, i.e. to the position shown in FIG. 4. The air cylinder 164 is then returned to the unactuated position shown in FIG. 3 so that the wheel 98 can now follow into the two lobes 92, 94 of the cam 88 as the latter rotates with the input shaft 74. In this double mode, the feeding section operates similarly as in the single mode, except now the upper flights of the belts 130 are shifted to the operative position twice per machine cycle as the wheel successively follows into both cam lobes 92, 94 per revolution of the input shaft 74. When the second cam lobe 92 raises the upper flights of the belts 130, the second time cycle of acceleration and deceleration of the output shaft 80 now becomes operative to feed a second end sheet from the stack 22 per machine cycle. Thus, two shorter sheets are successively and identically fed from the stack 22 per machine cycle. The stop dwell of the output shaft 80 between the two timed cycles enables the two successively fed sheets to be appropriately spaced apart while travelling through the machine 20. To process two shorter sheets per machine cycle, the printing, and die cutting sections 36, 37, 52, etc. are each set-up to perform two identical production operations per machine cycle. For example, each printing cylinder 38, 40 would be provided with a pair of identical, diametrically disposed printing dies each extending 180 degrees around the periphery of the respective printing cylinder; a pair of cutting dies would be similarly arranged on the die cutting roll of the die cutting section.

Should it be desired, the air cylinder 164 could be actuated every other machine cycle in the double mode to provide a modified type of skip feed in which two shorter sheets are successively fed during a first machine cycle and no sheets are fed during the next machine cycle, and so on.

In any of the modes of operation, i.e. single mode double mode, or skip feed, the air cylinder 164 can be actuated to render the cam follower wheel 98 inoperative and so stop sheet feeding.

With the above machine having a 66 inch machine cycle operating at 170 rpm, the production rate in the different modes would be approximately as follows:
single mode: 10,000 sheets per hour
single mode skip feed: 5,000 sheets per hour
double mode: 20,000 sheets per hour
As will be appreciated, the versatility of the above machine, particularly in being able to handle shorter sheets at twice the production rate of standard length sheets, enables more efficient use of corrugator machines which produce the initial corrugated paperboard blanks that are stacked in the above feeding section 26 when making container blanks. In particular, waste or unwanted widths from the corrugated paperboard web of the corrugator can be reduced or even substantially eliminated.

FIG. 9 represents the relative motion of the belts 130 and the output shaft 80 per machine cycle in the double mode and the single mode.

The curve 230 represents the two acceleration, deceleration and dwell cycles per machine cycle of the output shaft 80. The vertical ordinate axis represents angular acceleration (rad/sec$^2$) and the horizontal coordinate axis represents zero to 360 degrees of revolution of the input shaft 74, i.e. one machine cycle. As can be seen, the shaft 80 increases in acceleration from zero to a maximum acceleration, then decelerates through zero to a maximum deceleration after which deceleration rate decreases until a short dwell period 234 of zero acceleration is maintained. Immediately after the 180 degree point, the same rotational acceleration/deceleration cycle is executed a second time finishing in a second short dwell period 236 of zero acceleration. Immediately after the 360 degree point, the curve 230 repeats during the next and each succeeding machine cycle. The acceleration, deceleration and dwell at rest of the belts 130 follows the same curve as 230 except the vertical ordinates would be inches per second squared.

The curve 232 represents the velocity of the belts 130, more precisely the upper flights of the belts, per machine cycle. The vertical ordinate axis represents speed and the horizontal ordinate axis again represents zero to 360 degrees of one machine cycle. The belts 130 commence at rest, accelerate to a maximum speed at the point the curve 230 passes through zero, and then decelerate to rest again for the dwell period 234. The speed cycle of the belts 130 then repeats during the second half of the machine cycle until ending in the second dwell period 236.

During each machine cycle, the cams 88, 90 both rotate through 360 degrees. In the double mode of operation, the periods during each 360 degree machine cycle in which the upper flights of the belts 130 are in the operative and inoperative positions are indicated by the extent of the arrows marked BELTS UP and BELTS DOWN, respectively, in the upper part of FIG. 9 above the curves 232, 234. The corresponding operative and inoperative positions of the belts 130 in the single mode of operation are indicated by the extent of the arrows marked BELTS UP and BELTS DOWN, respectively, in the lower part of FIG. 9 below the curves 232, 234. In both single and double modes of operation, the spaces between the BELTS UP and BELTS DOWN arrows represents the periods during which the upper flights of the belts 130 are lowering or raising, as the case may be, that is when the cam follower wheel 98 is following the ramp portions 196 of either cam.

As is known to those skilled in the art, the feeding section 26 is timed to feed the sheets in register with the downstream machinery such as the printing, creasing, and/or slotting sections.

It will be appreciated that the above described preferred embodiment of the invention can be modified in many ways while still operating in accordance with the present invention.

For example, instead of feeding sheets from the lower end of the stack 22, the sheets could be fed from the upper end. In such an arrangement, the stack 22 would be supported on a conventional scissors lift and the rest of the mechanism of the feeding section 26 essentially inverted and positioned above the stack of sheets. For a further understanding of such an arrangement reference is again made to U.S. Pat. Nos. 4,494,745 (see FIGS. 6 and 7 thereof).

The indexing transmission 56 could be replaced by a similarly functioning, electronically controlled electric drive. Alternatively, the output shaft 80 could be driven from two 4-stop, 120 degrees index angle transmission units, operating 180 degrees out-of-phase, via unidirectional couplings; in such an arrangement, one of the two transmission units could be disengaged and rendered inoperative during the single mode of operation. The endless belts 130 could be replaced by wheels having a surface with a high coefficient of friction; or by oscillating slats having such a surface.

Also, the cams 88, 90 and the cam follower wheel 98 could be replaced by other suitable shifting means such as an electro-mechanical device, a pneumatic system, or a hydraulically actuated shifting arrangement.

The endless belts could be arranged to move rearwardly a slight distance, while in contact with the bottom sheet, before commencing the forward feeding motion; this would ensure that a warped bottom sheet when fed should more freely pass through the gate 28.

The single lobe cam 90 could be eliminated by using the air cylinder 164 to lift the cam follower lever 102 every other 180 degrees of rotation in the single feed mode, thus causing the belts, or other feeding means, to achieve the operative position only once per machine cycle. However, this has some disadvantages and is not considered as advantageous as using two cams.

It will be appreciated from the above, that the thrust of the present invention is to employ a cam arrangement, or equivalent means, that in normal use in the single mode of feeding is operative for less than 180 degrees of the machine cycle. Then employing a double lobe cam arrangement, or other means, to enable the remaining 180 degrees of the machine cycle to be used for feeding a second sheet per machine cycle in the double or dual mode of feeding.

The above described embodiments, of course, are not to be construed as limiting the breadth of the present invention. Modifications, and other alternative constructions, will be apparent which are within the spirit and scope of the invention as defined in the appended claims.

What is claimed is:

1. Sheet feeding apparatus for supplying sheets to cyclically operating downstream machinery, comprising:

supporting means for supporting a stack of sheets, the stack having an upper end and a lower end;

feeding means for feeding sheets from one of the ends of said stack, the sheets being fed one at a time in a forward direction towards and in register with the downstreamm machinery which performs a production operation on each fed sheet once per machine cycle of said downstream machinery;

shifting means for shifting said supporting means and said feeding means relative to each other in a direction transverse to said forward direction from an inoperative position, in which said feeding means cannot feed any sheet, to an operative position in which said feeding means can feed a respective one of said sheets, and then back to said inoperative position in a timed sequence which occupies less than half of one said machine cycle;

drive means for successively accelerating and decelerating said feeding means in a timed cycle which is less than half of one said machine cycle;

said drive means being capable of performing successively at least two such timed cycles per said machine cycle;

mode means, selectively operable between a single mode and a multiple mode, for causing said timed sequence of said shifting means to be carried out once per machine cycle in said single mode and more than once per machine cycle in said multiple mode; and interrelating means for interrelating said feeding means, said shifting means, said drive means, and said mode means with each other and said downstream apparatus to enable at least two sheets to be successively fed from said stack per said machine cycle in said multiple mode and only one sheet to be fed from said stack per said machine cycle in said single mode.

2. The sheet feeding apparatus of claim 1, wherein said shifting means includes two cams.

3. The sheet feeding apparatus of claim 2, wherein said shifting means includes a cam follower, and said mode means comprises means for displacing said cam follower relative to said cams to effect alignment of said cam follower with a first of said cams in said multiple mode and a second of said cams in said single mode.

4. The sheet feeding apparatus of claim 3, wherein said cams are mounted on a common rotatable shaft, said cam follower comprises a wheel mounted on an axle spaced from but parallel to said common shaft, said wheel being rotatable about an axis of said axle, and said displacing means displaces said wheel along said axis.

5. The sheet feeding apparatus of claim 4, wherein said displacing means comprises an air cylinder.

6. The sheet feeding apparatus of claim 3, wherein:

said two cams are mounted side by side on a common shaft, a first of said cams having two diametrically opposed cam lobes, and a second of said cams having only one cam lobe and this one cam lobe being aligned relative to said common shaft with one of the two cam lobes of said first cam; and said drive means comprises an indexing transmission having an output shaft drivingly connected to said feeding means and a continuously rotated input shaft, said output shaft performing two said timed cycles for each revolution of said input shaft.

7. The sheet feeding apparatus of claim 6, wherein said common shaft is also said input shaft.

8. The sheet feeding apparatus of claim 4, wherein said displacing means comprises two air cylinders, one for displacing said wheel in one direction along said axis and the other for displacing said wheel in the

9. The sheet feeding apparatus of claim 1, wherein said shifting means comprises a rotatable cam and a cam follower, and said cam has two diametrically opposed cam lobes.

10. The sheet feeding apparatus of claim 9, wherein said drive means comprises an indexing transmission which performs two said timed cycles per revolution of said cam.

11. The sheet feeding apparatus of claim 1, wherein said drive means comprises an indexing transmission having a continuously rotated input shaft and a rotatable output shaft, said output shaft being drivingly connected to said feeding means and performing said at least two timed cycles each revolution of said input shaft.

12. The sheet feeding apparatus of claim 1, wherein said feeding means comprises at least one endless belt having a friction surface for engaging the respective sheet to be fed. opposite direction along said axis, and said displacing means includes latching means for releasably latching said wheel against axial displacement when in alignment with either of said cams.

13. The sheet feeding apparatus of claim 1, wherein said interrelating means comprises gearing and timing belts.

14. Sheet feeding apparatus for feeding sheets to cyclically operating downstream machinery, comprising:

selectively operably feed means having first and second operating modes for feeding sheets one at a time to said downstream machinery from one end of a stack of sheets supported on a stack support means;

said feed means being adapted to feed one of said sheets during each cycle of said downstream machinery when in said first mode and adapted to feed two of said sheets during each cycle of said downstream machinery when in said second mode; and said feed means being further adapted to accelerate each sheet being fed from substantially zero velocity to a maximum velocity corresponding to an operating velocity of said downstream machinery with the rate of acceleration held the same in both said first and second operating modes.

15. The sheet feeding apparatus of claim 14, wherein said feed means includes an indexing transmission having a continuously rotated input shaft and an indexed output shaft, and at least two cams rotatable with said input shaft, one of the cams having a greater number of cam lobes than another of said cams.

16. Sheet feeding apparatus, comprising:

means for supporting a stack of sheets, the stack having an upper end and a lower end;

means for feeding sheets from one of the ends of said stack, the sheets being contacted and fed one at a time by at least one movable friction surface of the feeding means;

an indexing transmission having an output shaft and a continuously rotated input shaft, said output shaft being drivingly connected to said feeding means to drive said friction surface;

said transmission causing said output shaft to perform an output cycle comprising rotational acceleration followed by rotational deceleration, two such output cycles being performed by said output shaft for each revolution of said input shaft;

first and second cams drivingly rotated in unison with said input shaft, said first cam having two symmetrical cam lobes and said second cam having only one cam lobe;

a cam follower displaceable transversely with respect to said cams between first and second positions, said cam follower being actuated by said first cam in said first position and said second cam in said second position;

means for selectively displacing said cam follower from said first position to said second position and vice versa;

said cam follower, when actuated by either of said cams, cyclically shifting said feeding means and said supporting means vertically relative to each other between an operative position and in inoperative position, said friction surface contacting a respective sheet in said operative position but not being able to contact a respective sheet in said inoperative position; and said friction surface feeding successively two respective sheets for each revolution of said input shaft when said cam follower is in said first position, and said friction surface feeding only one respective sheet for each revolution of said input shaft when said cam follower is in said second position.

17. The sheet feeding apparatus of claim 16, wherein said first and second cams are mounted side by side on said input shaft, and said selectively displacing means displaces said cam follower along a direction parallel to said input shaft.

18. The sheet feeding apparatus of claim 17, wherein said cam follower is a wheel rotatably mounted on a pivotal lever.

19. The sheet feeding apparatus of claim 18, wherein said lever is resiliently biased to urge said wheel into engagement with the respective cam in said first and second positions, and further comprising means for selectively engaging said lever to retain said wheel in a position in which said wheel cannot follow the cam lobes of said cams and said feeding means is maintained in said inoperative position relative to said support means.

20. The feeding apparatus of claim 18, wherein said lever is connected to and actuates a mechanism for raising and lowering at least a portion of said friction surface relative to said support means.

21. The feeding apparatus of claim 18, wherein said selectively displacing means includes a yoke straddling said wheel, said yoke being mounted on a rod displaceable along a direction parallel to an axis of rotation of said wheel, and detent means for releasably locating said rod in either of two different locations along said direction.

22. A method of feeding sheets one at a time from one end of a stack of sheets to cyclically operating machinery, comprising the steps of:

frictionally feeding one of said sheets during each cycle of said cyclically operating machinery while feeding in a first mode of operation;

frictionally feeding two of said sheets during each cycle of said cyclically operating machinery while feeding in a second mode of operation;

accelerating each sheet while being frictionally fed from substantially zero velocity to a maximum velocity corresponding to an operating velocity of said cyclically operating machinery; and accelerating said sheets at the same rate of acceleration in both said first and second operating modes.

* * * * *